US006330959B1

(12) United States Patent
Dark

(10) Patent No.: US 6,330,959 B1
(45) Date of Patent: Dec. 18, 2001

(54) TAMPER EVIDENT CLOSURE

(76) Inventor: Richard C. G. Dark, 2248 Gum Tree La., Fallbrook, CA (US) 92028

( * ) Notice: Subject to any disclaimer, the term of this patent is extended or adjusted under 35 U.S.C. 154(b) by 0 days.

(21) Appl. No.: 09/657,238

(22) Filed: Sep. 7, 2000

(51) Int. Cl.[7] ..... B67B 5/00

(52) U.S. Cl. ..... 222/153.1; 222/536; 215/250; 215/252

(58) Field of Search ..... 215/252, 258, 215/43, 216, 221, 321, 250, 251; 222/535, 536, 153.1

(56) References Cited

U.S. PATENT DOCUMENTS 3,901,403 8/1975 Menke .
4,501,373 2/1985 Heinlein .
4,560,076 12/1985 Boik .
4,828,127 * 5/1989 Young et al. ..... 215/252
5,085,333 2/1992 Dutt et al. .
5,456,374 10/1995 Beck .
5,829,611 11/1998 Beck .
6,119,898 * 9/2000 Dark ..... 222/153.06

* cited by examiner

*Primary Examiner*—Kevin Shaver
*Assistant Examiner*—Melvin A. Cartagena
(74) *Attorney, Agent, or Firm*—Eric Karich

(57) ABSTRACT

A tamper evident closure for use on a container has a closure overcap shaped to fit onto a dispensing cap, the dispensing cap being shaped to fit onto the container. The closure overcap is connected to a tamper evident band by fragmentable webs, and the tamper evident band attaches to the dispensing cap, as described below, so that removal of the closure overcap requires the fragmentable webs to be broken, thus providing evidence of the access. The fragmentable webs are strong enough so that it is only easy to break the fragmentable webs one at a time. The dispensing cap includes an upwardly extending cam that functions to break the fragmentable webs one at a time when the closure overcap is twisted with respect to the dispensing cap.

7 Claims, 3 Drawing Sheets

TAMPER EVIDENT CLOSURE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to tamper evident closures, and more particularly to a tamper evident closure of a container, the tamper evident closure having a closure overcap that functions to hold a dispensing spout of the container in the closed position, the tamper evident closure further having an upwardly extending cam that functions to facilitate removal of the closure overcap.

2. Description of Related Art

Most containers that contain consumables that are in the retail market today, including bottles and dispensers, contain a tamper evident closure that enables the purchasers of these products to determine if someone else has already opened and re-closed the container. The tamper evident devices used include a visible feature to immediately indicate that the container has been opened. Tamper evident features allow purchasers to have confidence in the product, assuring them that nobody has tampered with the container.

A closure for a sports bottle, or similar dispensing container, is typically screwed onto the bottle. The closure typically has a tamper evident ring surrounding the base of the closure which is connected to the closure by fragmentable webs. When the closure is assembled to the bottle, the tamper evident ring snaps over a corresponding ring formed on the neck of the bottle. When the cap is removed from the bottle by unscrewing, the tamper evident ring stays on the bottle neck. The unscrewing forces lift the cap away from the tamper evident ring, breaking the fragmentable webs. An example of such a closure is shown in Beck, U.S. Pat. No. 5,456,374. Functionally equivalent closures that use multiple cams instead of threads are shown in Heinlein, U.S. Pat. No. 4,501,373 and Boik, U.S. Pat. No. 4,560,076. Even when the cap is replaced, it is obvious and visible to the consumer that these webs have been broken and that the product has been tampered with. If the purchaser found the bottle on a retailer's shelf with broken webs, he or she would know that it is best to leave it alone.

Similar tamper evident bands having fragmentable webs are also used to attach an overcap to the closures described above. Examples of such overcaps are shown in Beck, U.S. Pat. Nos. 5,829,611 and 5,456,374. As described above, if the overcap has been removed or otherwise tampered with, the broken fragmentable webs leave a readily visible warning to the consumer.

One disadvantage to these prior art closures is that they require the user to break all of the fragmentable webs at substantially the same time when unscrewing or otherwise removing the closure or overcap. This limits the strength of the fragmentable webs, because if the fragmentable webs are too strong, the user will have difficulty removing the closure or overcap.

This is an important consideration, because it is desirable to connect the overcap to the closure with fragmentable webs that are as strong as possible to prevent accidental breakage of the fragmentable webs. In the case of containers that have a pouring spout that can be opened and closed, it is also desirable to provide an overcap that is strongly attached to prevent the accidental opening of the closure, such as if the container is dropped.

The most common dispensing closure for beverages use a push-pull arrangement, most commonly used in sports bottles, such as shown in Beck, U.S. Pat. Nos. 5,829,611 and 5,456,374. These closures require that the user pull a button up which opens the dispensing orifice so that the product can be dispensed, generally by squeezing on the bottle. Another type of dispensing closure is disclosed in Dark, U.S. Pat. Nos. 4,440,327 and 5,392,968, whereby a spout is integrally hinged and seals in the down position and dispenses when lifted to the vertical position. The Dark invention can also be dispensed by squeezing on the container.

One of the drawbacks of the dispensing closure is that when in the sealed position and pressure is applied to the container, the pressure inside the container can push on the inside of the dispensing closure forcing it open. It is therefore advantageous to have an overcap that shows tamper evidence and not only keeps the dispensing closure clean and also helps to hold the dispensing mechanism in the sealed position.

The prior art has grappled with the challenge of providing a fragmentable web that is strong enough to securely fasten the overcap to the closure. Wilde, U.S. Pat. No. 4,923,073, teaches a tamper evident cap having a oblique groove into which fits a shaped locking ring. Twisting the cap both lifts the threadedly engaged cap and causes the tamper evident web to fracture in a serial manner; however, the fragmentable webs still break at least two at a time, so the strength of the fragmentable webs is limited. Furthermore, the unusual oblique structure of the groove makes assembly more difficult.

Another approach taken by the prior art has been to provide a tamper evident band that is torn off by the user, thereby breaking the fragmentable webs one at a time. Examples of such structures are shown in Menke, U.S. Pat. No. 3,901,403, and Dutt et al., U.S. Pat. No. 5,085,333. This approach is undesirable because it is preferred that the tamper evident band remain fastened to the closure, both for the purposes of waste disposal and for the purpose of providing a visual indication that someone has tampered with the container.

The prior art teaches tamper evident bands that are connected to a container or closure with fragmentable webs. However, the prior art does not teach an overcap connected to a closure with a tamper evident band that is unusually strong, the closure being designed so that the fragmentable webs are broken one at a time using a single upwardly extending cam. The present invention fulfills these needs and provides further related advantages as described in the following summary.

SUMMARY OF THE INVENTION

The present invention teaches certain benefits in construction and use which give rise to the objectives described below.

The present invention provides a tamper evident closure for use on a container. The tamper evident closure includes a closure overcap shaped to fit onto a dispensing cap, the dispensing cap being shaped to fit onto the container. The closure overcap is connected to a tamper evident band by a plurality of fragmentable webs, and the tamper evident band attaches to the dispensing cap, as described below, so that removal of the closure overcap requires the plurality of fragmentable webs to be broken, thus providing evidence of the access. The plurality of fragmentable webs are strong enough so that it is only easy to break the plurality of fragmentable webs one at a time. The dispensing cap includes an upwardly extending cam that functions to break the plurality of fragmentable webs one at a time when the closure overcap is twisted with respect to the dispensing cap.

A primary objective of the present invention is to provide a tamper evident closure having advantages not taught by the prior art.

Another objective is to provide a tamper evident overcap with strong fragmentable webs that help hold the dispensing spout in the sealed position.

A further object of my invention was to provide an upwardly extending cam for breaking the fragmentable webs one at a time, without undue effort.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
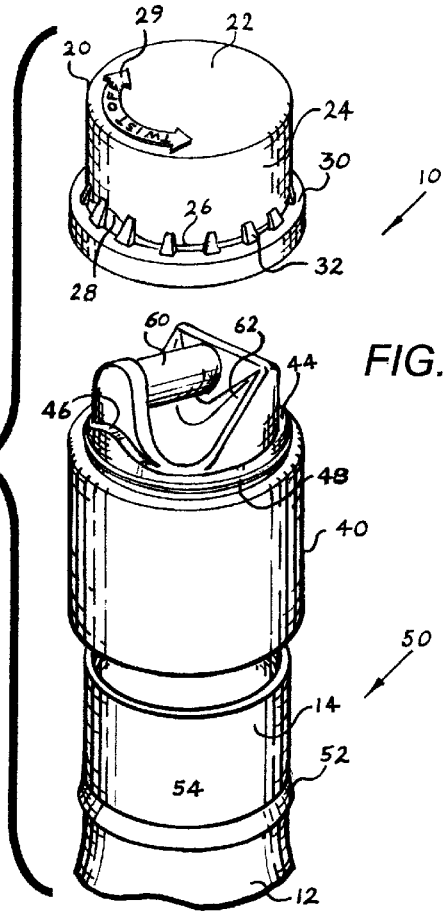
FIG. 1 is an exploded perspective view of the preferred embodiment of the present invention, a tamper evident closure for use with a container.
Figure 2:
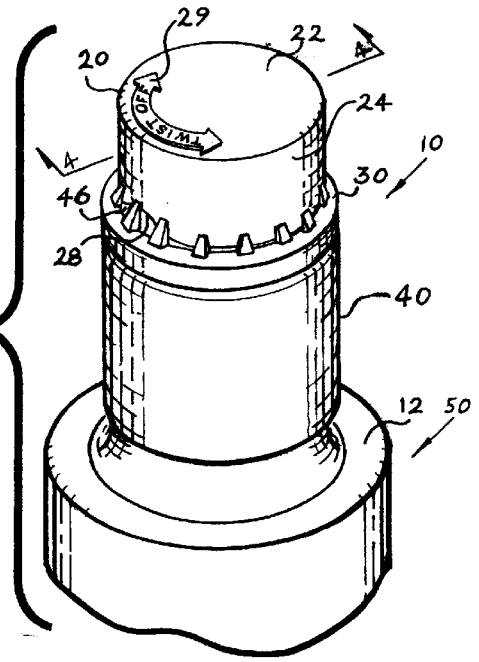
FIG. 2 is a perspective view thereof illustrating how the tamper evident closure is assembled on the container.

The above described drawing figures illustrate the invention, a tamper evident closure 10 for use on a container 12. As shown in FIGS. 1–11, the tamper evident closure 10 includes a closure overcap 20 shaped to fit onto a dispensing cap 40, the dispensing cap 40 being shaped to fit onto the container 12. The closure overcap 20 is connected to a tamper evident band 30 by a plurality of fragmentable webs 32, and the tamper evident band 30 attaches to the dispensing cap 40, as described below, so that removal of the closure overcap 20 requires the plurality of fragmentable webs 32 to be broken, thus providing evidence of the access. The plurality of fragmentable webs 32 are strong enough so that it is only easy to break the plurality of fragmentable webs 32 one at a time. The dispensing cap 40 includes an upwardly extending cam 46 that functions to break the plurality of fragmentable webs 32 one at a time when the closure overcap 20 is twisted with respect to the dispensing cap 40.

As shown in FIGS. 1–8, the closure overcap 20 has a top wall portion 22 that is generally circular and a skirt portion 24 depending therefrom that is generally cylindrical. The skirt portion 24 terminates in an overcap terminal edge 26. The overcap terminal edge 26 is planar, except for an indented portion 28 extending upwardly towards the top wall portion 22. The tamper evident band 30 is connected to the skirt portion 24 by the plurality of fragmentable webs 32, as described above. The plurality of fragmentable webs 32 are constructed of plastic and are strong enough so that a user can only comfortably break the plurality of fragmentable webs 32 one at a time, an important feature of the present invention. This is different than the prior art fragmentable webs, which must typically be weak enough so that the user can break the plurality of fragmentable webs 32 all at once, as shown in Beck, U.S. Pat. No. 5,456,374. The tamper evident band 30 also has an inwardly directed flange 34 to facilitate attachment of the tamper evident band 30 to the dispensing cap 40.

As shown in FIGS. 1–11, the dispensing cap 40 has a dispensing orifice 42 through a dispensing spout 60 surrounded by an annular cap shoulder upper surface 44. The annular cap shoulder upper surface 44 conforms to the overcap terminal edge 26 and including the upwardly extending cam 46. The upwardly extending cam 46 conforms to the indented portion 28 when aligned therewith. This conforming shape allows the closure overcap 20 to seat securely onto the dispensing cap 40 when the upwardly extending cam 46 is aligned with the indented portion 28. The upwardly extending cam 46 is preferably convex in shape, although other shapes having an upwardly directed slope can be used. A generally convex shape is preferred because a symmetric shape allows the closure overcap 20 to be turned in either direction for removal of the closure overcap 20.

Figure 3:
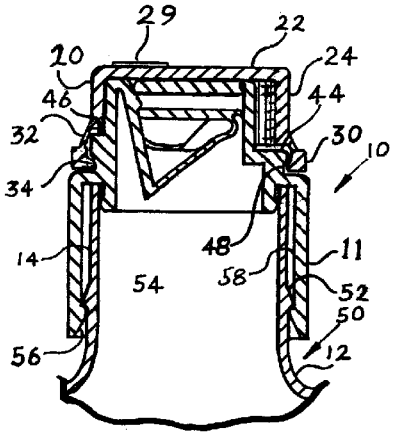
FIG. 3 is a sectional view thereof taken along line 4—4 in FIG. 2.
Figure 4:
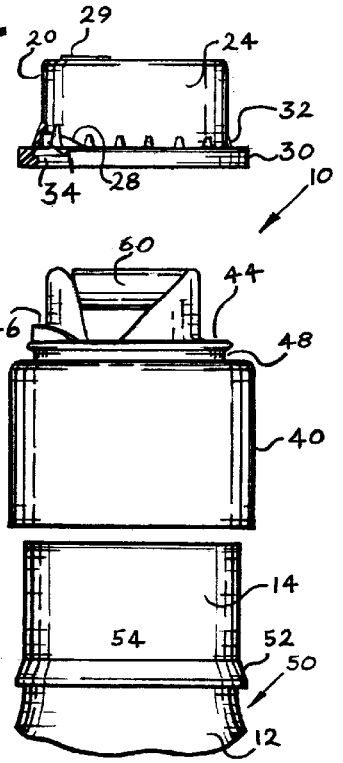
FIG. 4 is an exploded side elevational view thereof.

As shown in FIGS. 1 and 3, the dispensing cap 40 has an annular snap groove 48 formed in the dispensing cap 40 beneath the annular cap shoulder upper surface 44. The annular snap groove 48 is disposed in a plane that is parallel with a plane passing through the annular cap shoulder upper surface 44. The annular snap groove 48 receives and frictionally engages the inwardly directed flange 34 of the tamper evident band 30 when the overcap terminal edge 26 is seated against the annular cap shoulder upper surface 44; however, the tamper evident band is left free to rotate around the circumference of the dispensing cap 40.

The upwardly extending cam 46, best shown in FIGS. 1, 3, 4, 5, and 9, is a critical feature of the invention. When the closure overcap 20 is twisted, as shown in FIGS. 5–8, the upwardly extending cam 46 slides out of the indented portion 28 and along the overcap terminal edge 26. The upwardly extending cam 46 functions to pivot the closure overcap 20 with respect to the dispensing cap 40, thereby straining and breaking the plurality of fragmentable webs 32 one at a time. It is because of the unique action of the upwardly extending cam 46 that the plurality of fragmentable webs 32 are broken one at a time, and it is the fact that the plurality of fragmentable webs 32 are broken one at a time that the plurality of fragmentable webs 32 can be constructed especially strong. The closure overcap 20 preferably includes an engraving 29 that direct the user to twist the closure overcap 20 to open the container 12, to clarify the correct method of opening the closure overcap 20 without undue strain.

As shown in FIGS. 1 and 3, the dispensing cap 40 is secured to a neck 14 of the container 12 with a means for securing 50 the dispensing cap 40 onto the neck 14 of the container 12. It is important that the dispensing cap 40 be attached to the container 12 either so that it cannot be removed, or so that a second tamper evident feature is damaged. Without such a protection, a person would be able to defeat the tamper evident features of the tamper evident closure 10 by simply removing the dispensing cap 40 from the container 12. The means for securing 50 is preferably an annular container neck flange 52 on an outside surface 54 of the neck 14 of the container 12 that cooperates with an annular locking ring 56 of an inside surface 58 of the dispensing cap 40 to lock the neck 14 of the container 12 within the dispensing cap 40. In an alternative embodiment, the dispensing cap 40 is integral with the container 12. In yet another alternative embodiment, the dispensing cap 40 threadedly engages the neck 14 of the container 12. In this alternative embodiment, a second tamper evident indicator, such as another band with fragmentable webs 32, is required to indicate tampering in the event that the dispensing cap 40 is unscrewed from the container 12.

The dispensing orifice 42 of the dispensing cap 40 provides a passage through which the contents of the container 12 are dispensed. In a simple embodiment, the dispensing orifice 42 is merely an ordinary aperture (not shown) through the dispensing cap 40. In the preferred embodiment, as shown in FIGS. 1, 3, 4, 8, and 9, the dispensing orifice 42 is formed by a dispensing spout 60. The dispensing spout 60 is attached to a flexible diaphragm 62 of the dispensing cap 40 that allows the dispensing spout 60 to pivot between an upright, open position and a horizontal, closed position. A similar dispensing spout is disclosed in Dark, U.S. Pat. Nos. 4,440,327 and 5,392,968, hereby incorporated by reference in full. When the dispensing spout 60 is in the horizontal, closed position, the closure overcap 20 can be positioned on the dispensing cap 40. In this configuration, the top wall portion 22 of the closure overcap 20 contacts the dispensing spout 60 to hold it in the horizontal, closed position.

Figure 10:
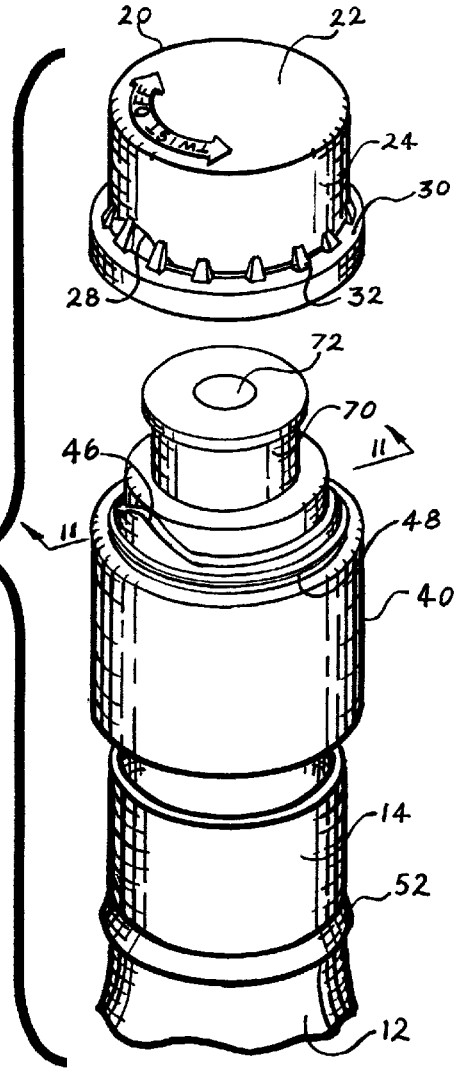
FIG. 10 is an exploded perspective view of an alterative embodiment of the dispensing cap.
Figure 11:
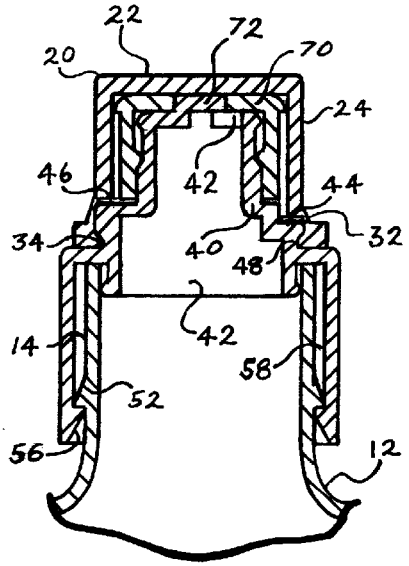
FIG. 11 is a sectional view thereof taken along line 11—11 in FIG. 10.

In an alternative embodiment, as shown in FIGS. 10 and 11, the dispensing orifice 42 is formed by a cylindrical cap 70 slidably engaged on an upwardly extending valve stem 72 that allows the cylindrical cap 70 to telescope between a raised, open position and a lowered, closed position. A similar cylindrical cap is disclosed in Lucas, U.S. Pat. No. 6,006,952, as well as Beck, U.S. Pat. Nos. 5,829,611 and 5,456,374, which are hereby incorporated by reference in full. When the cylindrical cap 70 is in the lowered, closed position, the closure overcap 20 can be positioned on the dispensing cap 40. In this configuration, the top wall portion 22 of the closure overcap contacts the cylindrical cap 70, holding it in the lowered, closed position.

In yet another alternative embodiment (not shown), the cylindrical cap 70 itself forms the element referred to as the closure overcap. The cylindrical cap 70 is slidably and rotatably engaged on the upwardly extending valve stem 72 as described above, only the cylindrical cap 70 is connected to the dispensing cap 40 by the tamper evident band 30 having the plurality of fragmentable webs 32 that are broken one at a time by the upwardly extending cam 46 when the cylindrical cap 70 is twisted relative to the dispensing cap 40.

The invention further includes a method for assembling the tamper-evident closure described above. First, the indented portion 28 is aligned with the upwardly extending cam 46. Once aligned, the closure overcap 20 is placed onto the dispensing cap 40 such that the overcap terminal edge 26 contacts the annular cap shoulder upper surface 44 and the upwardly extending cam 46 mates with the indented portion 28. The tamper evident band 30 is pushed downwards until the inwardly directed flange 34 snaps into the annular snap groove 48, thereby locking the tamper evident band 30 onto the dispensing cap 40. For this to be accomplished, the dispensing spout 60 must be in the horizontal, closed position. Once the closure overcap 20 is in position, the top wall portion 22 contacts the dispensing spout 60, serving to hold the dispensing spout 60 in the horizontal, closed position. This is important because it is undesirable for the dispensing spout 60 to open inadvertently, such as if the container 12 is dropped.

Figure 5:
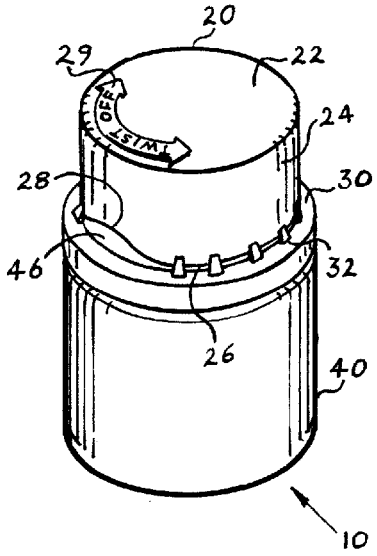
FIG. 5 is a perspective view of the tamper evident closure, some of a plurality of fragmentable webs being removed to more clearly illustrate an upwardly extending cam of a dispensing cap.
Figure 6:
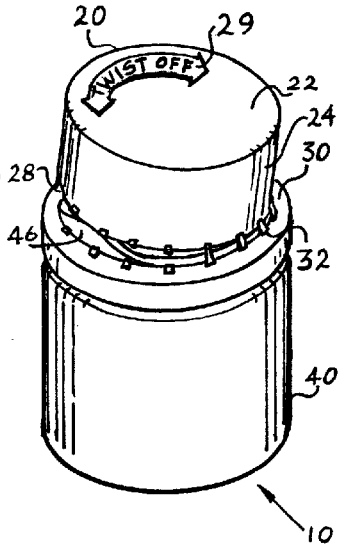
FIG. 6 is a perspective view thereof illustrating the closure overcap being turned such that the upwardly extending cam causes the closure overcap to pivot, thereby breaking the plurality of fragmentable webs one at a time.
Figure 7:
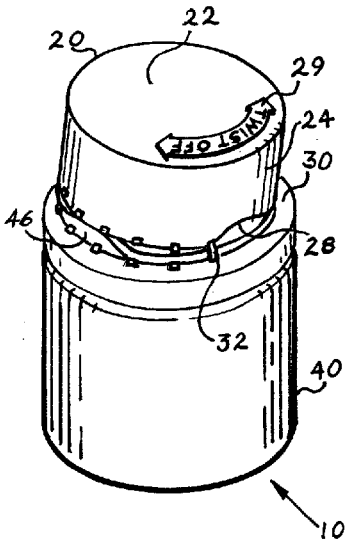
FIG. 7 is a perspective view thereof illustrating the last of the plurality of fragmentable webs being broken as the closure overcap is twisted through almost 360 degrees of rotation.
Figure 8:
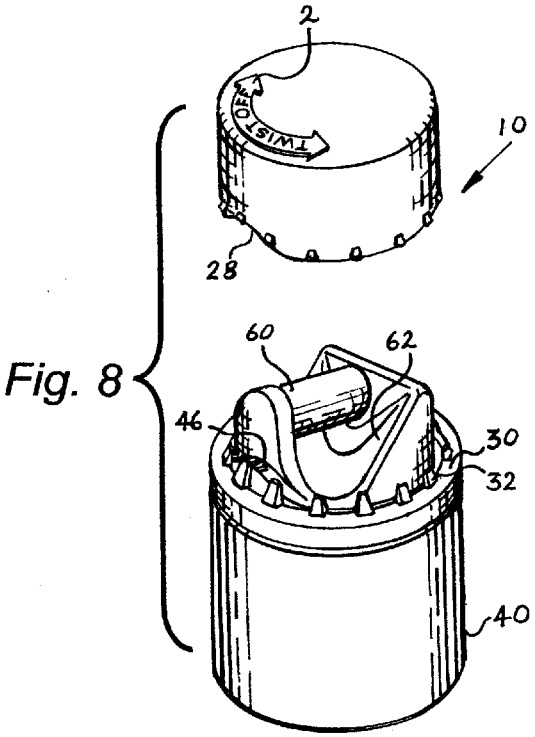
FIG. 8 is a perspective view thereof showing the closure overcap separated from the tamper evident band once all of the plurality of fragmentable webs have been broken.
Figure 9:
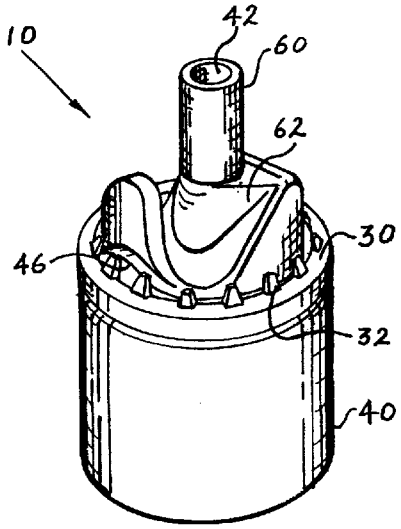
FIG. 9 is a perspective view of the dispensing cap once the closure overcap has been removed, illustrating a dispensing spout that has been pivoted from a horizontal, closed position to an upright, open position.

In use, the closure overcap 20 is twisted by the user, thereby causing the upwardly extending cam 46 to slide out of the indented portion 28 and along the overcap terminal edge 26. The movement of the upwardly extending cam 46 strains and breaks the plurality of fragmentable webs 32 one at a time. Once the upwardly extending cam 46 has been twisted 360 degrees back to the indented portion 28, as shown in FIGS. 5–7, it will have broken all of the plurality of fragmentable webs 32 and released the closure overcap 20 from the tamper evident band 30. Once the closure overcap 20 has been removed, as shown in FIGS. 8 and 9, the dispensing spout 60 can be pivoted to the upright, open position for dispensing the contents of the container 12.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A tamper evident closure for a container, the tamper evident closure comprising:

a closure overcap having a top wall portion and a generally cylindrical skirt portion depending therefrom, the skirt portion terminating in an overcap terminal edge, the overcap terminal edge being planar except for an indented portion extending upwardly towards the top wall portion;

a tamper evident band connected to the skirt portion by a plurality of fragmentable webs, the tamper evident band having an inwardly directed flange;

a dispensing cap having a dispensing orifice surrounded by an annular cap shoulder upper surface, the annular cap shoulder upper surface conforming to the overcap terminal edge, and including an upwardly extending cam conforming to the indented portion when aligned therewith;

an annular snap groove formed in the dispensing cap beneath the annular cap shoulder upper surface, the annular snap groove being disposed in a plane that is parallel with a plane passing through the annular cap shoulder upper surface, the annular snap groove receiving and frictionally engaging the inwardly directed flange of the tamper evident band when the overcap terminal edge seats against the annular cap shoulder upper surface; and whereby twisting the closure overcap when it is attached to the dispensing cap causes the upwardly extending cam to push the overcap terminal edge away from the annular cap shoulder upper surface, thereby breaking the plurality of fragmentable webs one at a time.

2. The tamper evident closure of claim 1 wherein the dispensing orifice is formed by a dispensing spout of the dispensing cap, the dispensing spout being attached to a flexible diaphragm that allows the dispensing spout to pivot between an upright, open position and a horizontal, closed position; and wherein the top wall portion contacts the dispensing spout to hold it in the horizontal, closed position when the closure overcap is positioned on the dispensing cap.

3. The tamper evident closure of claim 1 wherein the dispensing orifice is formed by a cylindrical cap of the dispensing cap, the cylindrical cap being slidably engaged on an upwardly extending valve stem that allows the cylindrical cap to pivot between a raised, open position and a lowered, closed position; and wherein the top wall portion contacts the cylindrical cap to hold it in the lowered, closed position when the closure overcap is positioned on the dispensing cap.

4. A combination container and tamper evident closure comprising:

a container having a neck;

a closure overcap having a top wall portion and a generally cylindrical skirt portion depending therefrom, the skirt portion terminating in an overcap terminal edge, the overcap terminal edge being planar except for an indented portion extending upwardly towards the top wall portion, a tamper evident band connected to the skirt portion by a plurality of fragmentable webs, the tamper evident band having an inwardly directed flange;

a dispensing cap having a dispensing orifice surrounded by an annular cap shoulder upper surface, the annular cap shoulder upper surface conforming to the overcap terminal edge, and including an upwardly extending cam conforming to the indented portion when aligned therewith, an annular snap groove formed in the dispensing cap beneath the annular cap shoulder upper surface, the annular snap groove being disposed in a plane that is parallel with a plane passing through the annular cap shoulder upper surface, the annular snap groove receiving and frictionally engaging the inwardly directed flange of the tamper evident band when the overcap terminal edge seats against the annular cap shoulder upper surface;

a means for securing the dispensing cap onto the neck of the container;

whereby twisting the closure overcap when it is attached to the dispensing cap causes the upwardly extending cam to push the overcap terminal edge away from the annular cap shoulder upper surface, thereby breaking the plurality of fragmentable webs one at a time.

5. The combination of claim 4 wherein the dispensing orifice is formed by a dispensing spout of the dispensing cap, the dispensing spout being attached to a flexible diaphragm that allows the dispensing spout to pivot between an upright, open position and a horizontal, closed position; and wherein the top wall portion contacts the dispensing spout to hold it in the horizontal, closed position when the closure overcap is positioned on the dispensing cap.

6. The combination of claim 4 wherein the dispensing orifice is formed by a cylindrical cap of the dispensing cap, the cylindrical cap being slidably engaged on an upwardly extending valve stem that allows the cylindrical cap to telescope between a raised, open position and a lowered, closed position; and wherein the top wall portion contacts the cylindrical cap to hold it in the lowered, closed position when the closure overcap is positioned on the dispensing cap.

7. A method for assembling a tamper-evident closure for a container, the method comprising the steps of a) providing a closure overcap having a top wall portion and a generally cylindrical skirt portion depending therefrom, the skirt portion terminating in an overcap terminal edge, the overcap terminal edge being planar except for an indented portion extending upwardly towards the top wall portion; and a tamper evident band connected to the skirt portion with a plurality of fragmentable webs, the tamper evident band having an inwardly directed flange;

b) providing a dispensing cap having a dispensing orifice surrounded by an annular cap shoulder upper surface, the annular cap shoulder upper surface conforming to the overcap terminal edge, and including an upwardly extending cam conforming to the indented portion when aligned therewith; and an annular snap groove formed in the dispensing cap beneath the annular cap shoulder upper surface, the annular snap groove being disposed in a plane that is parallel with a plane passing through the annular cap shoulder upper surface;

c) aligning the indented portion with the upwardly extending cam;

d) placing the closure overcap onto the dispensing cap such that the overcap terminal edge contacts the annular cap shoulder upper surface and the upwardly extending cam mates with the indented portion; and e) sliding the tamper evident band downwards until the flange snaps into and frictionally engages the annular snap groove.

* * * * *